US005466091A

United States Patent [19]

Sauerwein et al.

[11] Patent Number: 5,466,091

[45] Date of Patent: Nov. 14, 1995

[54] SURFACE DRAINAGE APPARATUS

[75] Inventors: Heinrich Sauerwein, Nubbel; Wolfgang Arm, Rendsburg, both of Germany

[73] Assignee: ACO Severin Ahlmann GmbH & Co., KG, Rendsburg, Germany

[21] Appl. No.: 162,438

[22] Filed: Dec. 3, 1993

[30] Foreign Application Priority Data

Dec. 10, 1992 [DE] Germany ..... 42 41 703.1

[51] Int. Cl.[6] ..... E02B 11/00

[52] U.S. Cl. ..... 405/36; 405/118

[58] Field of Search ..... 405/118, 119, 405/36; 404/2–5

[56] References Cited

U.S. PATENT DOCUMENTS

| | | | |
|---|---|---|---|
| 1,693,190 | 11/1928 | Benedetti . | |
| 4,844,655 | 7/1989 | Aleshire | 405/118 |

FOREIGN PATENT DOCUMENTS

| | | |
|---|---|---|
| 0081741A1 | 6/1983 | European Pat. Off. . |
| 0081762A1 | 6/1983 | European Pat. Off. . |
| 0200008A1 | 11/1986 | European Pat. Off. . |
| 0204278A2 | 12/1986 | European Pat. Off. . |
| 0248427A3 | 12/1987 | European Pat. Off. . |
| 0345222A2 | 5/1989 | European Pat. Off. . |
| 0345222A3 | 9/1991 | European Pat. Off. . |
| 0476672A1 | 3/1992 | European Pat. Off. . |
| 2659096 | 9/1991 | France . |
| 2347869A1 | 4/1975 | Germany . |
| 3133658A1 | 6/1982 | Germany . |
| 8520189 | 10/1985 | Germany . |
| 8802530 | 5/1988 | Germany . |
| 1519357 | 7/1978 | United Kingdom . |
| 2233016 | 2/1991 | United Kingdom . |

*Primary Examiner*—David H. Corbin

*Attorney, Agent, or Firm*—Marshall, O'Toole, Gerstein, Murray & Borun

[57] ABSTRACT

Surface drainage apparatus comprises a channel body defining a drainage channel with a cover defining apertures through which drainage can pass into the drainage channel. A fixing means is provided for attachment of the cover to the channel body and comprises a first fixing element for attachment to the channel body and a complementary second fixing element for attachment to the cover. The channel body defines at least one universal receiving aperture into which one of a plurality of differently constructed first fixing elements is capable of being located both before and after installation of said surface drainage apparatus. In this way both the production costs and the operating costs of the surface drainage apparatus can be reduced, especially when conversion is necessary.

29 Claims, 8 Drawing Sheets

SURFACE DRAINAGE APPARATUS

FIELD OF THE INVENTION

The present invention relates to surface drainage apparatus and in particular to a drainage channel with a cover or a grating which can be set on and connected to a channel body embedded in the ground and defining the drainage channel.

DESCRIPTION OF THE PRIOR ART

In European patent EP 81 762 C1 a drainage channel of this kind is described wherein to the upper edges of the channel body frames of cast metal are attached that provide seating for the cover.

To attach the cover to the channel body fixing means are provided that comprise on the one hand parts that can be attached to the cover and on the other hand complementary parts that can be attached to the channel body.

These fixing means can take various forms. When the surface drainage apparatus must meet particularly high requirements, in general screw bolts are used as the fixing means and these are screwed into threaded bores, comprising the complementary parts, defined by in the frames. Such an arrangement is relatively costly to produce, because the threads must be tapped into the finished channel.

Furthermore, fixing means are known that operate on various principles not involving screws. Examples of these are described in European patents EP 204 278 A2, EP 476 672 A1 and German patent DE 31 33 658 A1. These known arrangements are also relatively expensive to manufacture.

In European patent EP 81 741 B1 is described a fixing means comprising a cross-bar, in the middle of which is a threaded bore into which is screwed a screw bolt that passes through a bore in the cover. To serve as the complementary part, in the body of the channel cutouts are provided, positioned substantially opposite one another and formed in such a way that when the cover is screwed down the cross-bar is swung into the cutouts and held there. This fixing means is used especially when intermediate to slight firmness of fixation is required.

It is common to all arrangements that a particular configuration of channel body to be embedded in the ground is associated with a particular configuration of the fixing means or of the cover. One consequence of this is that it is impossible to adapt the surface drainage apparatus to changing demands, so that when the demands increase, in particular, entirely new systems must be installed. The operating costs of conventional kinds of surface drainage apparatus are therefore high. Another consequence is that the known systems are relatively expensive to manufacture, because variety in product lines involves less efficient use of machinery and increased warehousing costs.

SUMMARY OF THE INVENTION

The object of the present invention is to provide a surface drainage apparatus of simple construction, combining ease of operation with a reduction of overall costs compared with conventional apparatus.

According to the present invention there is provided surface drainage apparatus comprising a channel body defining a drainage channel, a cover for the drainage channel defining apertures through which drainage can pass into said drainage channel, a fixing means for attachment of said cover to said channel body and comprising a first fixing element for attachment to said channel body and a complementary second fixing element+ for attachment to said cover, said channel body defining at least one universal receiving aperture into which said one of a plurality of differently constructed first fixing elements is capable of being located both before and after installation of said surface drainage apparatus.

Thus in the present invention the channel body does not simply comprise a single type of second fixing element but is provided with a universal receiving aperture into which various kinds of second fixing elements can be fitted. In this way only a single version of channel body needs to be manufactured, which considerably reduces the costs of manufacture and warehousing. The manufacture of the second fixing elements, which are easier to manipulate than the complete channel bodies, is simple. The costs of storing stock are, therefore kept low even if there are many different kinds of second fixing elements.

In addition to the receiving apertures for the various kinds of fixing elements, the channel body can also be provided with cutouts to receive a cross-bar, as mentioned above in the description of the prior art arrangements.

Preferably, the receiving aperture is formed so that the first fixing element can be removed therefrom after installation of the surface drainage apparatus. This feature makes subsequent conversion very simple.

Preferably also, a plurality of damping elements are provided and the channel body defines a plurality of the receiving apertures which are each formed so as to receive at least one first fixing element and one damping element to attenuate relative movement between the cover and the channel body. Damping elements of this kind are known per se but by this means the costs can be still further reduced, because no special configuration of channel body is necessary to accommodate the damping elements, which are needed only in special cases.

Preferably also, the first fixing element defines a threaded bore into which said second fixing element in the form of a screw can be fitted. This arrangement makes it considerably simpler to produce a screw-type connection. In particular, it is not necessary to tap a thread in the frame of an otherwise finished channel body.

Alternatively, the first fixing element comprises a clamping spring and the second fixing element comprises a peg formed with an enlarged end that is a leading end for insertion of the peg into said clamping spring, the clamping spring and the peg being constructed so that the peg can be inserted into a receiving opening defined by the clamping spring and retained therein after insertion in a direction substantially perpendicular to the plane of the cover thereby elastically deforming the spring. This provides a screwless fixation mechanism and the snap seating of the peg into the clamping spring ensures adequate fixation and makes assembly, i.e. the placement of the cover on the channel body, extremely simple.

Preferably also, the enlarged end of the peg is biconical in form with a first vertex at said leading end and a second vertex pointing away from said leading end at a less acute angle than said first vertex. As a result, the forces required for assembly are smaller than those needed to lift the cover away.

Preferably also, the receiving opening is of elongate shape and the peg can be inserted therein at any point along the length of the receiving opening. Thus the process tolerances of channel body and cover can be relatively high.

Preferably also, the clamping spring is attached to the channel body with sufficient play that the peg can move the clamping spring during insertion into the receiving opening. This again serves to permit large tolerances in the production of channel body and cover.

Preferably also, the receiving opening is of elongate shape and the peg can be inserted therein at any point along the length of the receiving opening, and the clamping spring is attached to the channel body with sufficient play in a direction perpendicular to the long axis of the receiving opening so that the peg can move the clamping spring in a direction perpendicular to the long axis during insertion into the receiving opening. Thus two degrees of freedom are ensured in different ways, which results in a very stable structure.

Preferably also, the clamping spring substantially comprises a ribbon shaped to define an open looped portion and two opposed curved retaining sections, each of which is continuous at one end with an end of the looped portion and curved outwards of the looped portion at its other end, and the clamping spring is seated in such a way that the outwardly curving other ends of the clamping spring overlap opposite edges defining its seating. This arrangement both makes assembly simple and ensures that the clamping spring can be displaced.

When it is desirable to ensure greater retaining forces for the cover, the peg can preferably be rotated about its long axis and the enlarged end has two surfaces on opposite sides thereof which are spaced by a distance substantially equal to the diameter of the enlarged end so that when said surfaces are apposed to the retaining sections of the clamping spring the peg expands the clamping spring to permit the peg to be withdrawn from the clamping spring via the receiving aperture. With suitable dimensioning of both the conical angle of the enlarged end of the peg and of the seating for the clamping spring, it can be made impossible for the peg to become disengaged. Hence the cover can be lifted away from the channel body only if the peg is rotated.

Preferably also, the clamping spring is attached to a flat member which can be inserted into the receiving aperture in the form of a pocket at the side of the channel body. It is further advantageous for the cover to comprise a retaining lug that prevents the flat member from slipping out of the pocket when the cover is seated on the channel body.

The site of attachment of a clamping spring need not be a receiving aperture. In a modification, the cross-bar mentioned above can be used instead or in addition for this purpose.

Preferably also, the second fixing element comprises a bolt that is mounted in the cover so as to be capable of sliding into a locking position in the direction toward a long edge defined by the cover and back out of this locking position into an opened position, and said first fixing element comprises a retaining means which when the bolt slides into the locking position engages with the bolt in such a way that the cover is retained on the channel body. Such bolt is relatively simple to manufacture and to attach captively to the cover. In this case the cover is preferably a cast grating.

Preferably also, the bolt comprises a catch spring that engages the cover by interlocking with a notch defined by the cover in such a way that the bolt is thereby restrained in either the locking position or the opened position, or both, against movement. As a result unintentional opening or removal of the cover is impossible.

The bolt is preferably mounted in one of the apertures of the cover that serve as an inlet for the drainage water to the drainage channel. Thus the cover is not additionally weakened.

Preferably also, the bolt defines an opening which, when it is in the locking position, together with the aperture in which it is disposed forms a composite opening the area of which is substantially equal to that of the other apertures defined by the cover. One result of this is to satisfy the aesthetic requirements, and another is to avoid reducing the influx cross-section for the intake of water.

Preferably also, the aperture in which the bolt is disposed has the form of a slot open toward a long edge defined by said cover. With this arrangement, the bolt can be pushed into the opening from outside.

Preferably also, the bolt comprises a cover plate which in the locking position closes off the slot up to the long edge. This ensures that the surface of the cover is uniform, with no depressions, so that no dirt can collect.

Preferably also, after installation of the apparatus a top surface of the bolt is recessed below a top surface of the cover by an amount sufficient that when a vehicle is driven over the cover no load is imposed on the bolt means. Usually fractions of a millimeter suffice for this purpose. This ensures that the guides through which the bolt slides always allow free passage.

Preferably also, the bolt is of substantially I-shaped cross section in a plane perpendicular to its sliding direction and the aperture in the cover is correspondingly formed in that it comprises rails that are enclosed by the bolt.

Preferably also, the bolt comprises a clearing means for clearing dirt away from the slide path of said bolt means during opening, as the bolt slides from said locking position into said opened position. The bolt can thereby easily be opened even after prolonged use. The clearing means are particularly simple to construct when they comprise beveled surfaces to raise the dirt during sliding. The dirt is therefore not compacted but instead is actually cleared out of the way.

Preferably also, the retaining means comprises a lug that projects into a retaining recess defined by said cover in the region of said bolt, and wherein said bolt comprises a retaining section that can extend under said lug. Such a lug can very easily be cast integrally with a frame attached to the channel body in which the cover locates. The lug and the retaining recess are preferably complementarily shaped so that displacement of the cover in a direction of the long edge, i.e. in the long direction of a drainage channel, is prevented. The fixing mechanism to fasten the cover over the drainage channel hence simultaneously secures the cover against slippage along the channel.

Preferably also, the cover comprises two long edges and defines a plurality of openings spaced along these long edges, and a plurality of hook-in elements are provided on the channel body which engage in the openings when the cover is set into place on said channel body. With this arrangement, fewer bolts are needed to provide secure retention of the cover on the channel body. In addition, the hook-in elements and the openings are disposed symmetrically on the channel body and the cover respectively in such a way that the cover can be set in place on the channel body in either of two ways round. Placement of the cover on the channel body is thereby facilitated.

Preferred embodiments of the invention will now be described in greater detail with reference to the accompanying drawings.

DESCRIPTION OF THE PREFERRED EMBODIMENTS

Figure 1:
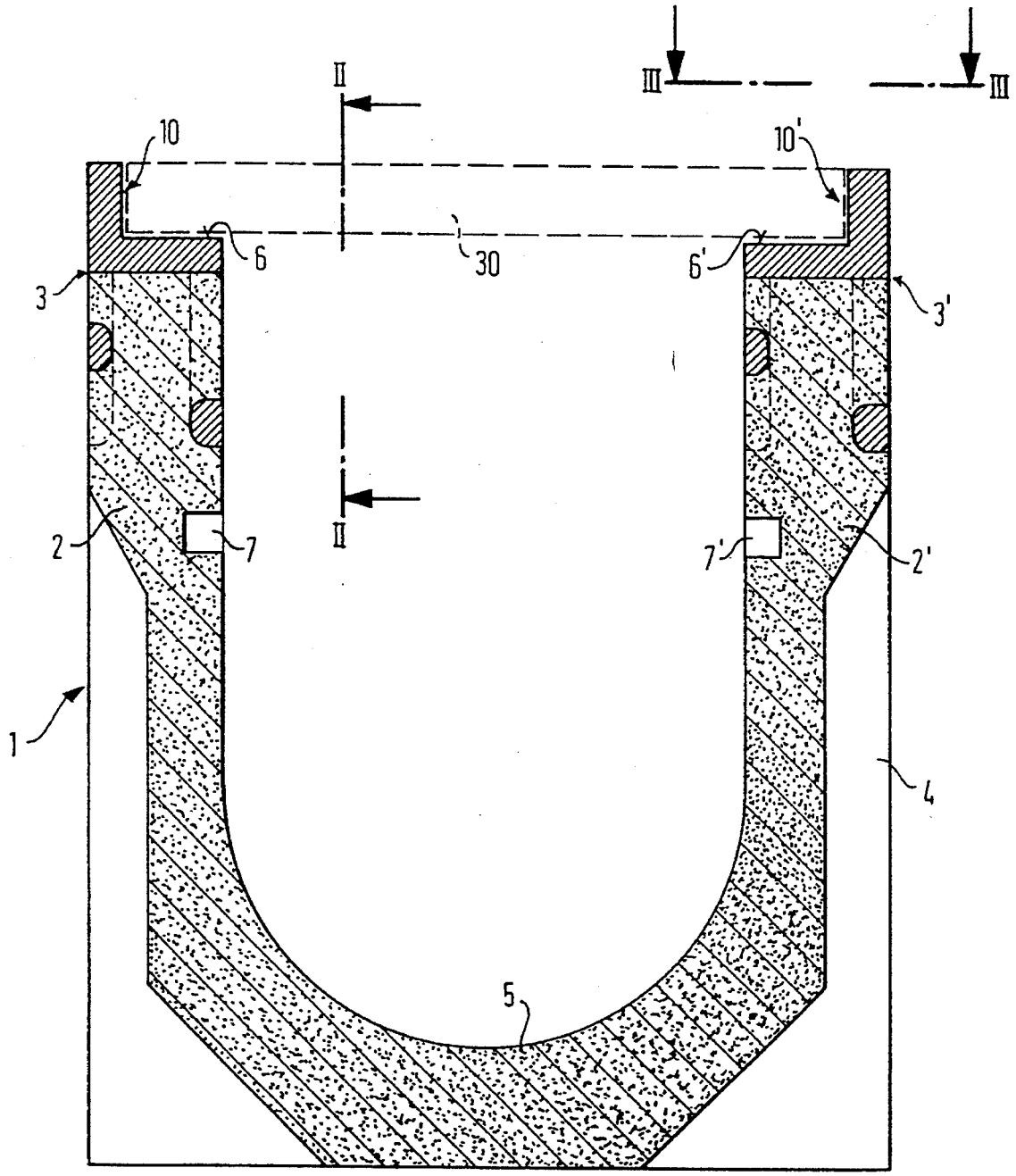
FIG. 1 is a transverse cross-section of a channel body with an attached frame according to the invention.

In the following description the same elements or parts with the same function are identified by the same reference numerals.

FIG. 1 shows a cross section of a drainage channel, which comprises a channel body 1 with upwardly extending side walls 2, 2' and a bottom 5 as well as reinforcing ribs 4. At the upper edges 3, 3' of the channel 1, frames 10, 10' are sealed into the material, typically a polymeric concrete, of the rest of the channel body. The frames 10, 10' comprise support surfaces 6, 6' onto which can be placed a cover 30 (indicated by dashed lines in FIG. 1).

Defined in the inner surfaces of the side walls 2, 2' are receiving openings or cutouts 7, 7' to receive a cross-bar.

The configuration of the frames 10, 10', which are identical to one another, will now be described in greater detail.

Figures 2, 3, 4, 5, 6, 7, 8:
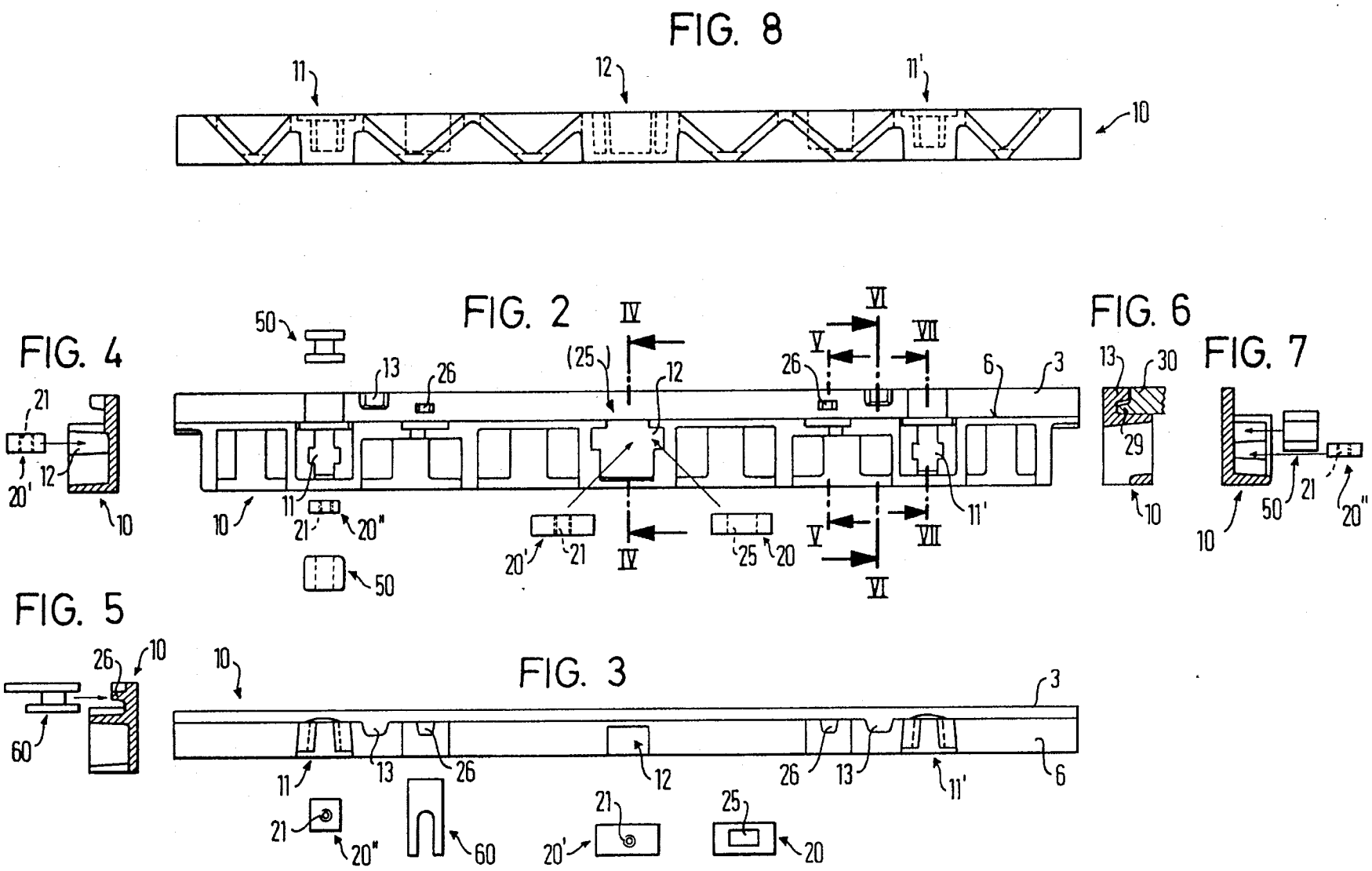
FIG. 2 is a view of the frame along the line II—II in FIG. 1.
FIG. 3 is a view of the frame along the line III—III in FIG. 1.
FIG. 4 is a sectional view through the frame along the line IV—IV in FIG. 2.
FIG. 5 is a sectional view along the line V—V in FIG. 2.
FIG. 6 is a sectional view along the line VI—VI in FIG. 2.
FIG. 7 is sectional view along the line VII—VII in FIG. 2.
FIG. 8 is a view from below of the frame shown in FIG. 2.

The frames 10, 10' are so shaped as to be symmetrical about their vertical midline, corresponding to the line IV—IV in FIG. 2. Near the edges receiving openings or first pockets 11, 11' are provided, and in the middle there is a second receiving opening or pocket 12. The pockets 11, 11' and 12 are so formed that fixing elements 20 can be set into them. These are described further below.

Furthermore, the frames 10, 10' include hook-in elements 13 that can be set into corresponding recesses in the cover 30 such that outwardly projecting retaining members 29 lie under the hook-in elements 13 and thereby secure the cover 30 from being lifted up at the corresponding edge. This too will be described in more detail below.

The pockets 11, 11' are so formed that damping elements 50 can be inserted into them instead of fixing elements 20. The damping elements 50 are formed of a resilient synthetic material in a manner known per se and are so dimensioned that they extend above the support surfaces 6, 6' by a sufficient amount that they are somewhat compressed when the cover 30 is in place.

The frames 10, 10' are further provided with lugs 26 that can cooperate with bolts 60 that can be disposed in a cover 30. The function of this arrangement is described further below.

In FIGS. 2 to 4 and in FIG. 7 are shown fixing elements 20' and 20", which include threaded bores 21, so that a cover 30 can be secured to the channel by means of screws.

FIG. 3 shows a fixing element 20 that defines a rectangular opening 25. This opening serves to receive a clamping spring as described further below.

The pockets 11, 11' and 12 are slightly conical in shape so that they taper toward their interior (upward in FIG. 3). This configuration makes it possible to drive correspondingly dimensioned fixing elements 20 in with light hammer blows so that they are seated securely in the pockets 11, 11' or 12. However, by using a screwdriver or similar means it is possible to free the fixing elements 20 from the pockets 11, 11' or 12.

A complementary fixing element in the form of a clamping spring will now be described in detail with reference to FIGS. 9 to 18 that can be inserted either into the fixing element 20 (with rectangular opening 25) or directly into the frames 10, 10'. In the case of direct insertion into the frame 10, 10' the opening over the middle pocket 12 is shaped to correspond to the opening 25.

Figure 9:
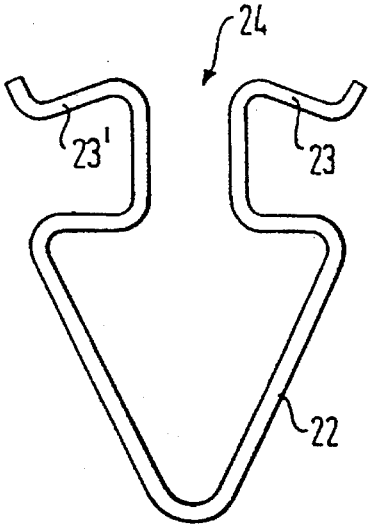
FIG. 9 is a side view of a clamping spring.

The clamping spring shown in FIG. 9 comprises a lower spring portion 22, which is looped into a substantially V-shape. Alternatively,it could be made U-shaped or semicircular.

At the upper end of the clamping spring 20 retaining sections 23, 23' are provided, which are substantially U-shaped in cross section and each of which is integral by means of one of its limbs with one limb of the lower looped spring portion 22. The openings of the retaining sections 23, 23' face outward, so that between the two sections an elongated receiving opening 24 is formed. These clamping springs can be made of a ribbonlike metal strip or of a plastics material.

Figure 13:
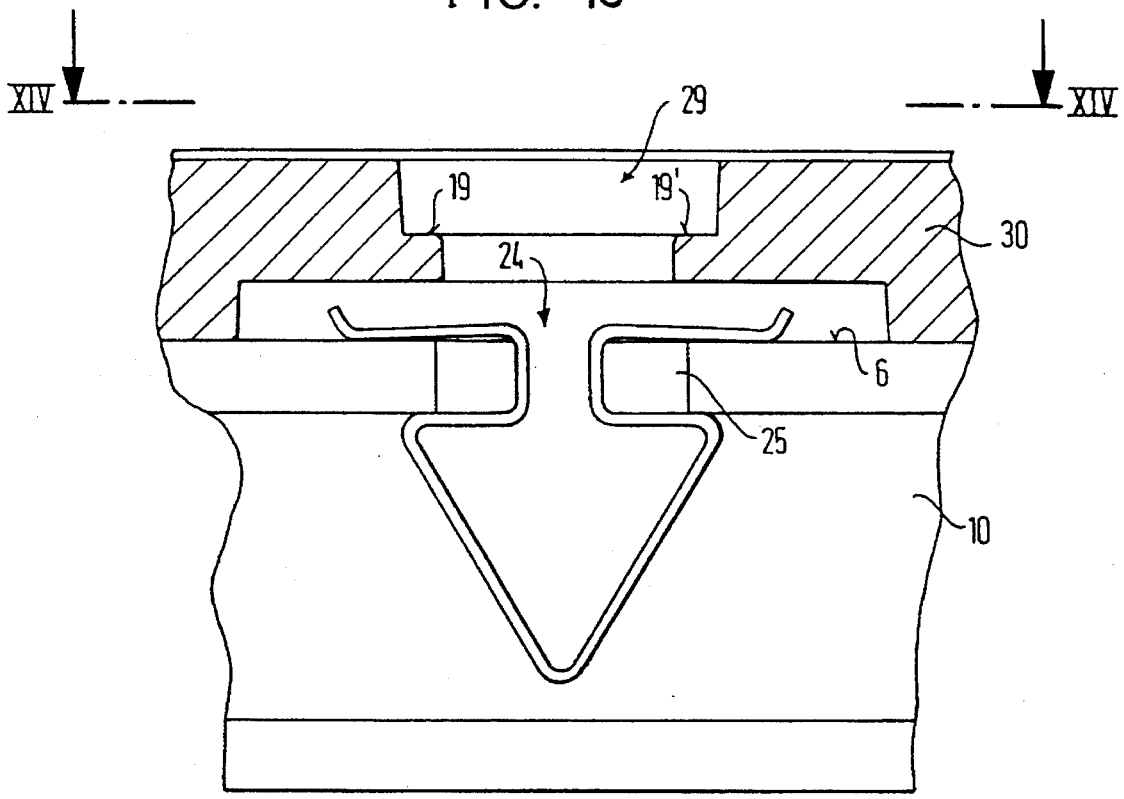
FIG. 13 is a partial longitudinal section through a drainage channel with a cover in place.

The clamping springs are inserted either into a fixing element 20, cf. FIG. 2, or directly into the frame 10, 10' as shown in FIGS. 13 to 18. In the latter arrangement, the frame 10, 10' and the clamping springs are dimensioned so that, as shown in FIG. 13, the clamping spring can be shifted to the left and right so that the edges of the opening 25 overlap the retaining portions 23, 23' to a greater or lesser extent.

Figure 11:
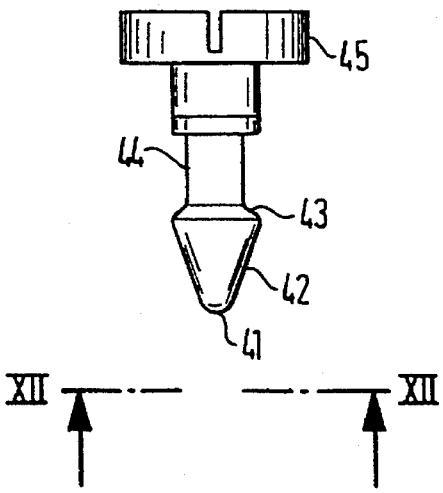
FIG. 11 is a view of the fixing element along the line XI—XI in FIG. 10.

Attached to the cover 30 is a fixing element 40 in the form of a peg that, as shown in FIG. 11, defines a biconical enlarged end with a tip 41 at the end of a conical surface 42. The conical surface 42 is continuous with a conical retaining surface 43 that slants in the opposite direction, the angle of the retaining surface 43 being steeper than that of the conical surface 42. The retaining surface 43 in turn is continuous at its narrow end with a shaft 44, at the end of which a broadened head 45 is attached.

Figure 14:
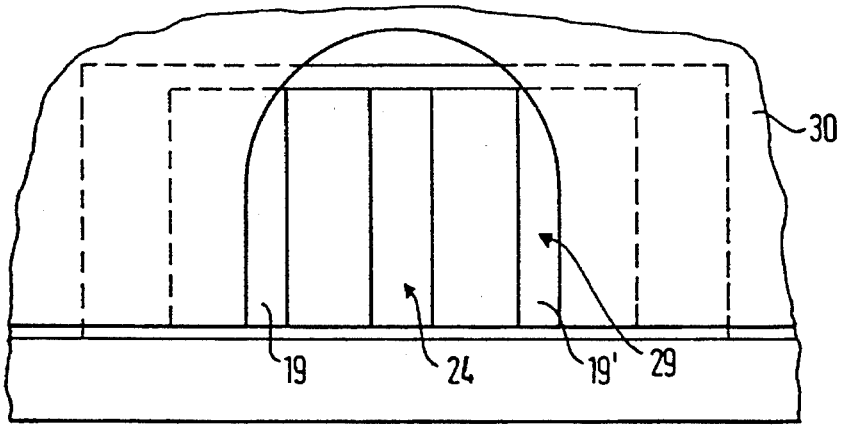
FIG. 14 is cross-sectional view along the line XIV—XIV in FIG. 13.
Figure 15:
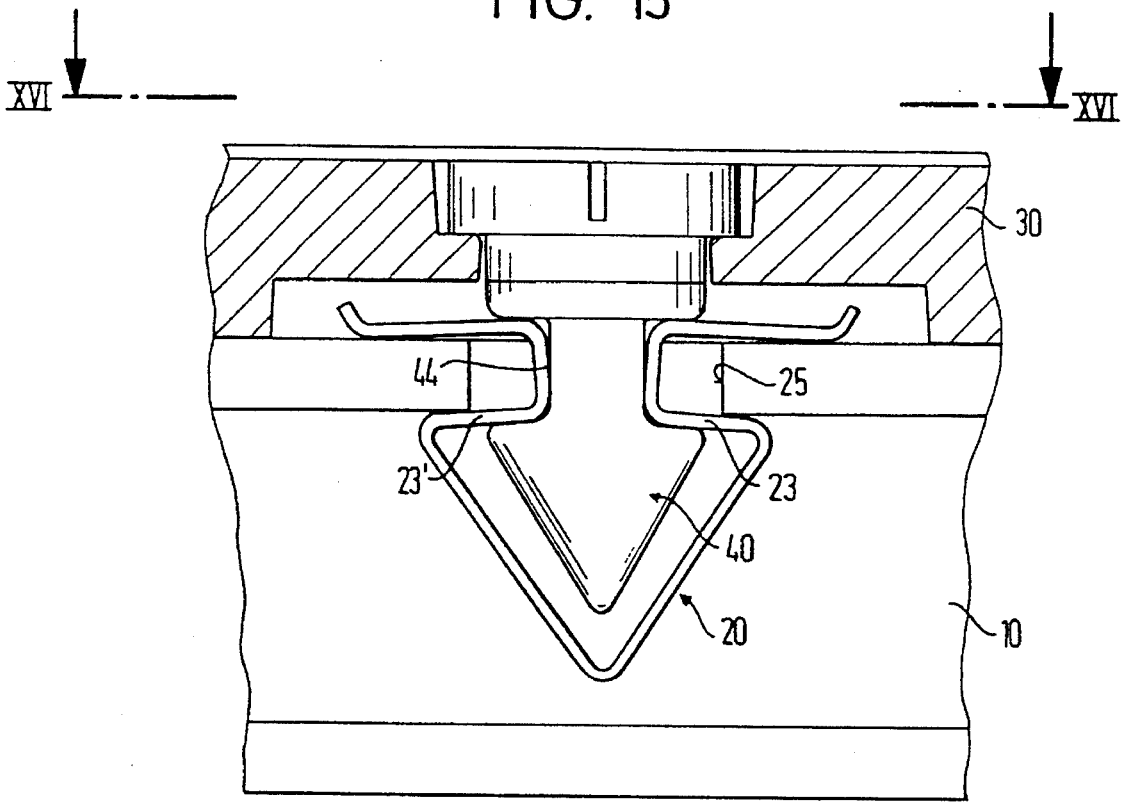
FIG. 15 is a view similar to that of FIG. 13 but with a fixing element inserted.

The cover 30 defines a receiving aperture 29A, as shown in FIGS. 13 and 14, through which a fixing element 40 can be inserted into the opening 24 until its broadened head 45 comes to rest on a stop surface 19 of the receiving aperture 29A. This position is shown in FIG. 15. Here the retaining portions 23, 23' are seated on the slanted retaining surface 43 in such a way that it is practically impossible to pull the fixing element 40 out of the clamping spring.

The fixing element 40 can have a symmetrical shape, in which case the retaining surface 43 is so formed that it is possible to lift up the cover 30 by exerting sufficient force.

Figure 12:
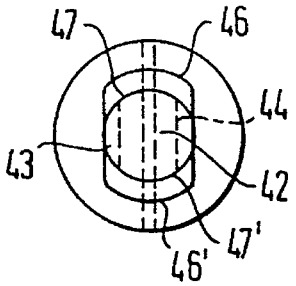
FIG. 12 is a view of the fixing element along the line line XII—XII in FIG. 11.
Figure 10:
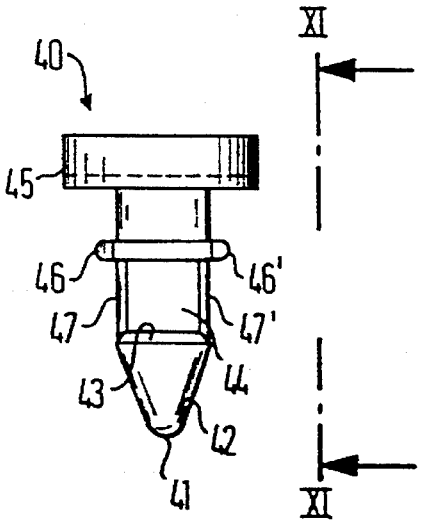
FIG. 10 is a side view of a fixing element.

In the preferred embodiment of the invention shown in the accompanying drawings, the fixing element 40 as shown in FIGS. 10 to 12 is not radially symmetrical. Instead, it comprises two expansion surfaces 47, 47', which have substantially the same diameter as the conical surface 42 at its enlarged end. These expansion surfaces 47, 47' are directly opposite one another. At a 90° angle to them the peg is indented to form the retaining surfaces 43 and the shaft 44, resulting in the configuration shown in FIGS. 10 to 12.

The fixing element 40 also comprises retaining lugs 46, 46' which, when the element 40 is rotated into the position shown in FIG. 17, project below the stop surfaces 19, 19' to keep the element 40 from falling out of the receiving aperture 29A. When the element 40 is rotated into the position shown in FIGS. 15 and 16, the lugs 46 and 46' are no longer under the stop surfaces 19, 19' but rather are within the receiving aperture 29A. Thus, the fixing elements 40 can be inserted into a cover 30 and captively retained there.

Instead of the expansion surfaces 47, 47' shown in FIGS. 10 and 12, it is also possible to provide sections in which the retaining surface 43 and corresponding parts of the conical surface 42 are eliminated by extension of the shaft 44 to form parallel plane surfaces. However, the variant shown in FIGS. 10 to 12 is preferred inasmuch as unintentional rotation of the fixing element 40 into an unfastened position is prevented because such rotation would require expansion of the clamping spring.

When the cover 30 is placed on the channel 1 or its frames 10, 10', the tip 41 of the fixing element 40 enters the receiving opening 24 and, if it is not quite centered, shifts the clamping spring to the right or left, as shown in FIG. 13, so that the receiving opening 24 becomes symmetrically disposed with respect to the long axis of the element 40. Because of the elongated shape of the receiving opening 24, it makes essentially no difference at which end of the opening 24 the fixing element 40 is inserted. Downward pressure expands the lower spring portion 22, so that the retaining portions 23, 23' move outward and the receiving opening 24 becomes wider, until the conical surface 42 has been pushed completely into the receiving opening 24. As the fixing element 40 is pushed further inward into the position wherein it can be rotated as shown in FIG. 15, the lower spring portion 22 comes together again so that the receiving opening 24 slides along the retaining surface 43 until the cover 30 is seated securely on the support surfaces 6, 6'. The dimensions of the various parts are here such that when the cover 30 is fixed in place, the position of the retaining sections 23, 23' with respect to the retaining surface 43 shown in FIG. 15 is ensured.

Figure 16:
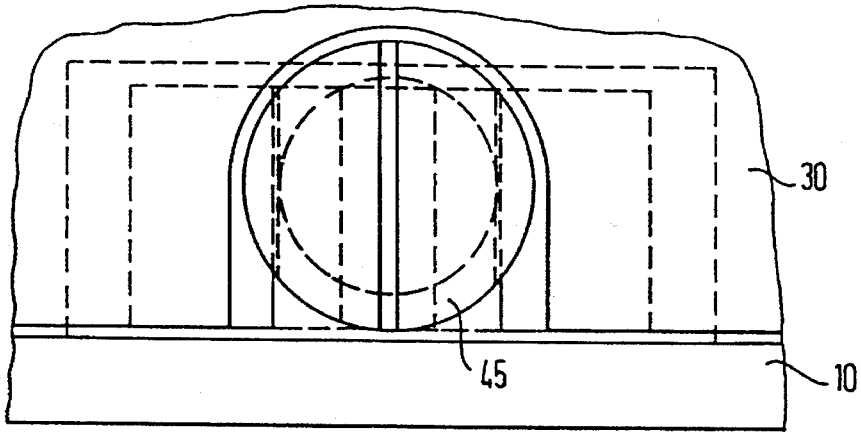
FIG. 16 is a view along the line XVI—XVI in FIG. 15.
Figure 17:
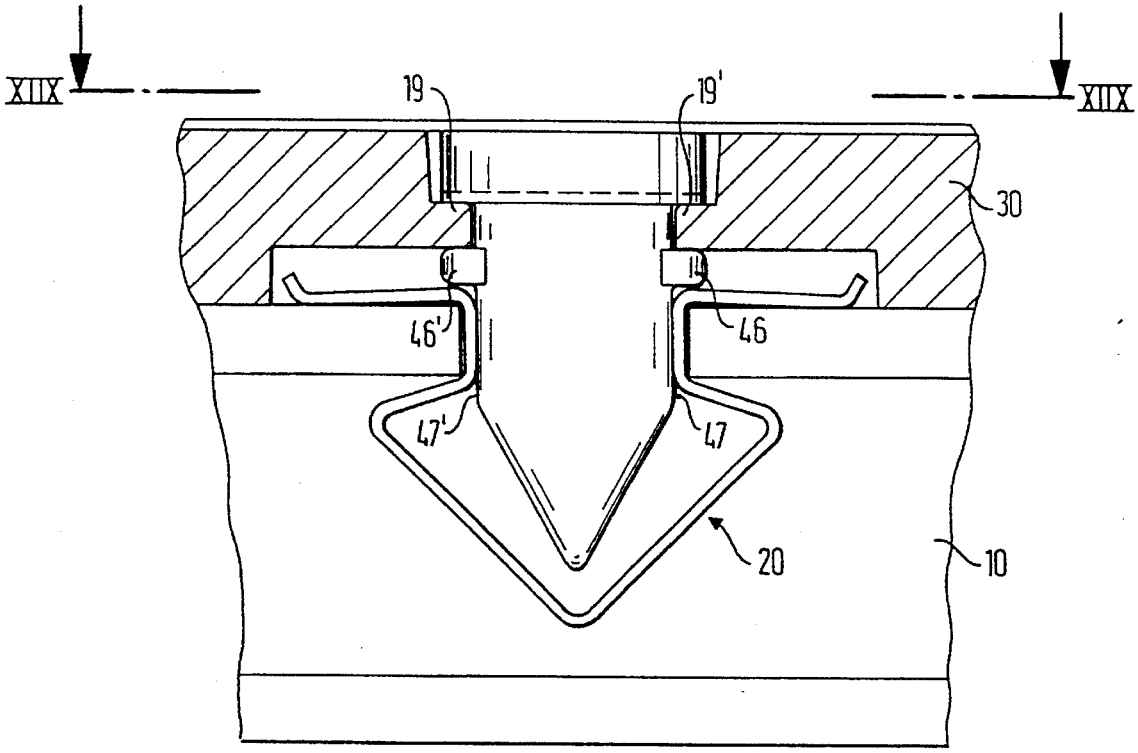
FIG. 17 is a view similar to that of FIG. 15 but with the fixing element rotated.
Figure 18:
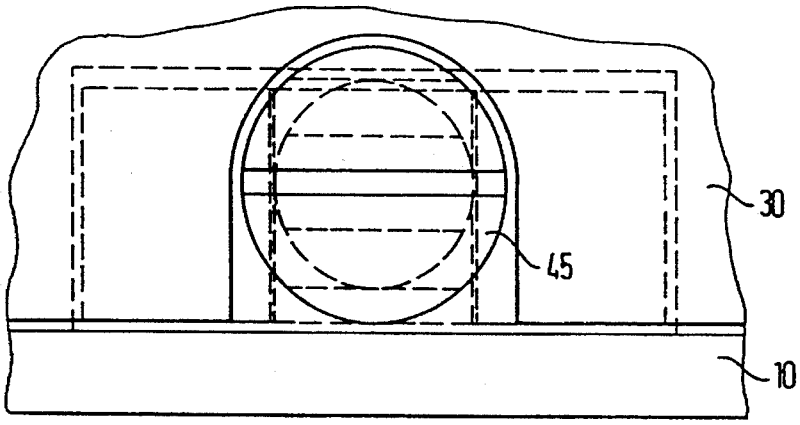
FIG. 18 is a view along the line XVIII—XVIII of FIG. 17.

When the fixing element 40 is rotated out of the position shown in FIGS. 15 and 16 through 90°, the position shown in FIGS. 17 and 18 results. In this latter position the expansion surfaces 47, 47' expand the clamping spring so that the cover 30 can be lifted away. To put the cover in place, it makes no difference, in principle, which rotational position the fixing element 40 is in. However, the rotational position as shown in FIG. 17 is preferred, so that the cover 30 can be finally secured to the channel 1 or the frames 10, 10' by rotating the fixing element 40 through 90°.

A second preferred embodiment of the invention will now be described with reference to FIGS. 19 to 27.

As shown in FIGS. 19 to 23, in this embodiment the cover 30 defines apertures 31, 31' separated from one another by ribs 37. The long edges 32, 32' of the cover 30 define on one long edge 32' hook-in openings 39 comprising recesses in the surface of the cover 30 so that the retaining pieces 29 are formed below the hook-in openings 39.

The frames 10, 10' are equipped with the above-mentioned hook-in elements 13, which can be inserted into the hook-in openings 39 so that the frames 10, 10' rest on the retaining pieces 29. On the other long edge 32, the cover 30 defines openings 39', which pass through the entire cover 30 so that there are no retaining pieces 29 on the other long edge 32.

Figure 19:
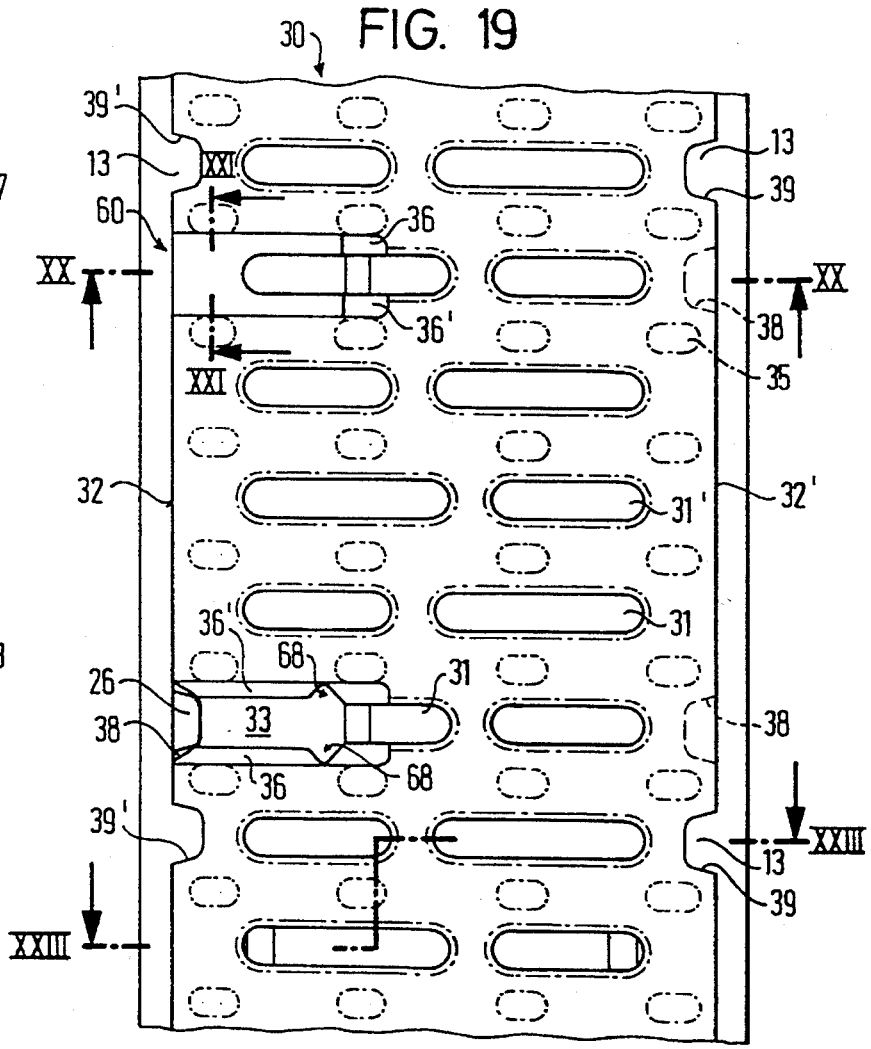
FIG. 19 is a partial plan view of a surface drainage apparatus with a cover in place according to a second embodiment of the invention.

In the embodiment shown in FIG. 19, two spaced apertures 31 formed in the cover 30 are extended to the long edge 32 by way of a slot 33. At its end toward the edge 32 this slot 33 forms a retaining recess 38, which is shaped so that the lug 26 on the channel is held within it in a substantially form-fitting manner. This arrangement effectively prevents the cover 30 from being displaced in the long direction of the channel.

Figure 20:
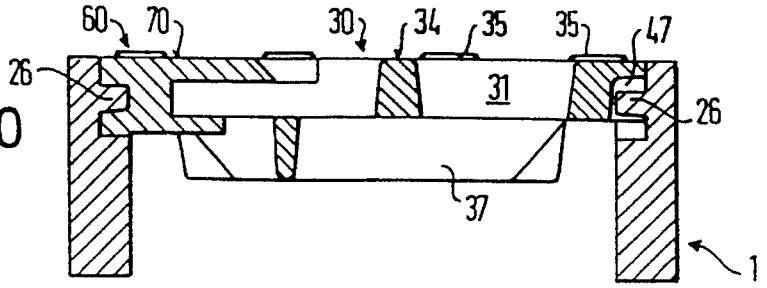
FIG. 20 is a sectional view along the line XX—XX in FIG. 19.

As shown in FIG. 20, there is an open space above and below the lug 26.

The slot 33 or the associated aperture 31 is provided with guide rails 36, 36' that project inward into the slot or the opening 31. The rails 36, 36' are provided with notches 68.

Figure 21:
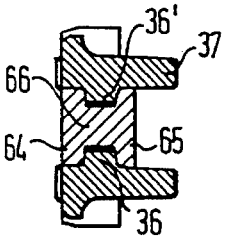
FIG. 21 is a sectional view along the line XXI—XXI in FIG. 19.
Figure 22:
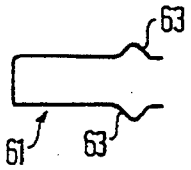
FIG. 22 is a plan view of a catch spring.
Figure 23:
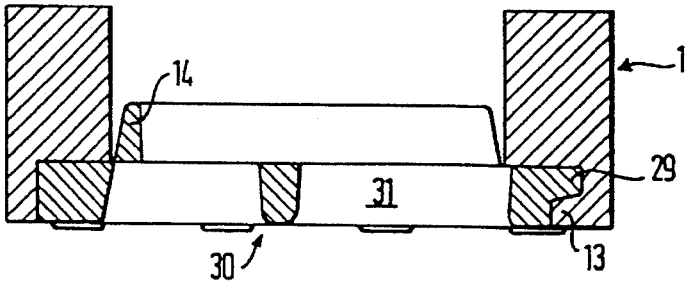
FIG. 23 is a sectional view along the line XXIII—XXIII in FIG. 19.
Figure 27:
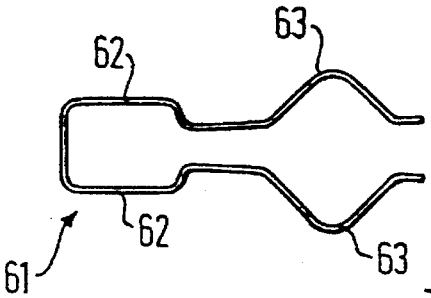
FIG. 27 is a plan view of a catch spring in a second preferred embodiment of the invention.
Figure 24:
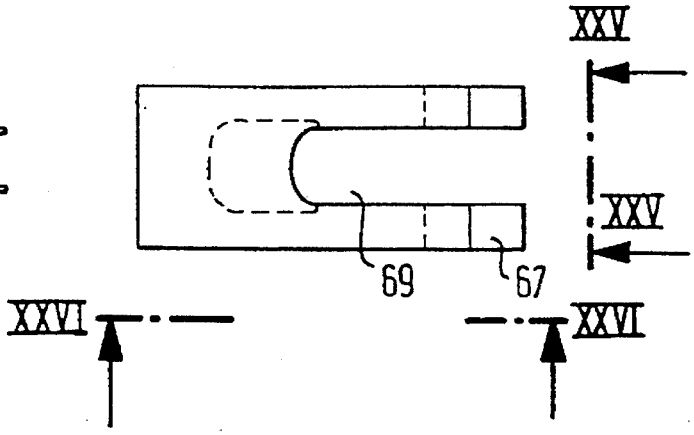
FIG. 24 is a plan view of a bolt.
Figure 25:
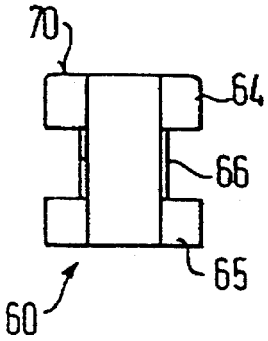
FIG. 25 is a front elevation of the bolt along the line XXV—XXV in FIG. 24.

Into each of the apertures 31 provided with the slots 33 there is inserted a bolt 60, which has a substantially I-shaped cross section as shown in FIGS. 21 and 25. In particular, the bolt 60 comprises an upper cover plate 64 and a floor plate 65, which is connected to and separated from the cover plate 64 by a neck 66.

At its end toward the long edge 32, the neck 66 is set back with respect to both the floor plate 65 and the cover plate 64 by a distance such as to form a retaining section that can extend under the lug 26. The cover plate 64 is extended outward, toward the long edge 32, far enough that when the bolt 60 is in a locking position as shown in FIG. 19, the end of the cover plate 64 is substantially flush with the long edge 32.

At its end away from the long edge 32, the cover plate 64 is provided with beveled surfaces 67, so that during sliding of the bolt 60 (to the right in FIG. 19), dirt on the rails 36, 36' can be lifted off.

To secure the bolt 60 in its locking position as well as in its opened position, a catch spring 61 is provided, with a retaining portion 62 (FIG. 27) that encloses the neck 66. At its end the catch spring 61 comprises outwardly curved portions 63, which engage the notches 68 when the bolt 60 is in its locking position.

The bolt 60 also defines an opening 69, so that its ends, between the beveled surfaces 67, define a forklike configuration. The opening 69 is so constructed that the total area of the composite opening formed by the opening 69 and the residual region of the aperture 31 with slot 33 corresponds to the area of the other apertures 31 in the cover 30. This can be seen in FIG. 19.

Figure 26:
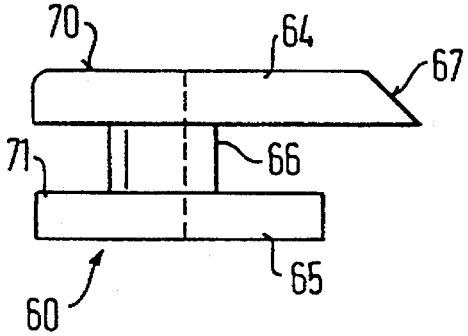
FIG. 26 is a side elevation of the bolt along the line XXVI—XXVI in FIG. 24.

The surface 70 of the cover plate 64, as shown in FIG. 26, is somewhat lower than the surface of the cover 30, so that when vehicles are driven over the cover 30, no force acts on the bolt 60 or its surface 70. Moreover, the cover 30 is formed with knobs 35 that project above its surface 34, which both help to prevent skidding and reduce load imposed on the bolt 60 by crossing traffic.

The bolt 60 is preferably made of high-stability metal, for example of an aluminum diecast alloy, with its surface passivated to avoid corrosion.

As shown in the drawings, the frames 10, 10' are symmetrical with respect to the lugs 26. Accordingly, along the long edge 32', opposite the long edge 32 at which the bolts 60 are situated, cavities 47A, as shown in FIG. 20, are provided to make room for the lugs 26 that are not actually needed on the long edge 32'. This arrangement ensures that the cover 30 can be placed on the channel 1 in any desired orientation.

The procedure by which a cover 30 as shown in FIGS. 19 to 27 is fitted is first to tilt the cover 30 and hook it under the hook-in elements 13 by means of the retaining pieces 29. Then, with the bolts 60 slid back (to the right as shown in FIG. 19), the cover 30 is set completely in place, after which the bolts 60 are closed (slid to the left as shown in FIG. 19) until the curved portions 63 of the catch springs 61 engage with the notches 68. In this position the retaining sections 71 of the bolts 60 are seated under the lugs 26, so as effectively to prevent the cover 30 from being lifted away from the channel body 1 or the frames 10, 10'. The cover is removed by proceeding in a reverse sequence.

On the cover 30, preferably in the region of the pockets 11, 12, downward-projecting retaining pieces 14 are provided, which close off the pockets 11, 12 toward the interior of the channel. With this arrangement, a fixing element seated in a pocket 11 or 12 cannot slip out.

What is claimed is:

1. Surface drainage apparatus comprising a channel body defining a drainage channel, a cover for the drainage channel defining apertures for passing drainage into said drainage channel, a fixing means for attachment of said cover to said channel body comprising a first fixing element for attachment to said channel body and a complementary second fixing element for attachment to said cover, said channel body defining at least one universal receiving aperture for installing a first fixing element of a plurality of differently constructed first fixing elements and for replacing said first fixing element by a differently constructed first fixing element both before and after installation of said surface drainage apparatus.

2. Apparatus as claimed in claim 1, wherein said receiving aperture is formed so that said first fixing element can be removed therefrom after installation of said surface drainage apparatus.

3. Apparatus as claimed in claim 1, comprising a plurality of damping elements and wherein said channel body defines a plurality of said receiving apertures which are each formed so as to receive at least one said first fixing element and one said damping element to attenuate relative movement between said cover and said channel body.

4. Apparatus as claimed in claim 1, wherein said first fixing element defines a threaded bore into which said second fixing element in the form of a screw can be fitted.

5. Apparatus as claimed in claim 1, wherein said first fixing element comprises a clamping spring and said second fixing element comprises a peg formed with an enlarged end that is a leading end for insertion of said peg into said clamping spring, said clamping spring and said peg being constructed so that said peg can be inserted into a receiving opening defined by said clamping spring and retained therein after insertion in a direction substantially perpendicular to the plane of the cover thereby elastically deforming the spring.

6. Apparatus as claimed in claim 5, wherein said enlarged end is biconical in form with a first vertex at said leading end and a second vertex pointing away from said leading end at a less acute angle than said first vertex.

7. Apparatus as claimed in claim 5, wherein said receiving opening is of elongate shape and said peg can be inserted therein at any point along the length of said receiving opening.

8. Apparatus as claimed in claim 5, wherein said clamping spring is attached to said channel body with sufficient play that said peg can move said clamping spring during insertion into said receiving opening.

9. Apparatus as claimed in claim 5, wherein said receiving opening is of elongate shape and said peg can be inserted therein at any point along the length of said receiving opening, and said clamping spring is attached to said channel body with sufficient play in a direction perpendicular to the long axis of said receiving opening so that said peg can move said clamping spring in a direction perpendicular to said long axis during insertion into said receiving opening.

10. Apparatus as claimed in claim 5, wherein said clamping spring substantially comprises a ribbon shaped to define an open looped portion and two opposed curved retaining sections, each of which is continuous at one end with an end of said looped portion and curved outwards of said looped portion at its other end, and wherein said clamping spring is seated in such a way that said outwardly curving other ends of said clamping spring overlap opposite edges defining its seating.

11. Apparatus as claimed in claim 10, wherein said peg can be rotated about its long axis and said enlarged end has two surfaces on opposite sides thereof which are spaced by a distance substantially equal to the diameter of said enlarged end so that when said surfaces are apposed to said retaining sections of said clamping spring said peg expands said clamping spring to permit said peg to be withdrawn from said clamping spring via said receiving opening.

12. Apparatus as claimed in claim 5, wherein said clamping spring attached to a flat member which can be inserted into said receiving aperture in the form of a pocket at the side of said channel body.

13. Apparatus as claimed in claim 1, wherein said second fixing element comprises a bolt that is mounted in said cover so as to be capable of sliding into a locking position in the direction toward a long edge defined by said cover and back out of this locking position into an opened position, and wherein said first fixing element comprises a retaining means which when said bolt slides into said locking position engages with said bolt in such a way that said cover is retained on said channel body.

14. Apparatus as claimed in claim 13, wherein said bolt means comprises a catch spring that engages said cover by interlocking with a notch defined by the cover in such a way that said bolt is thereby restrained in said locking position against movement.

15. Apparatus as claimed in claim 13, wherein said bolt comprises comprises a catch spring that engages said cover by interlocking with a notch defined by the cover in such a way that said bolt is thereby restrained in said opened position against movement.

16. Apparatus as claimed in claim 13, wherein said bolt is mounted in one of said apertures of the cover.

17. Apparatus as claimed in claim 16, wherein said bolt defines an opening which, when said bolt is in said locking position, together with said one aperture in which said bolt is disposed forms a composite opening the area of which is substantially equal to that of said other apertures defined by said cover.

18. Apparatus as claimed in claim 16, wherein said aperture in which said bolt means is disposed has the form of a slot open toward a long edge defined by said cover.

19. Apparatus as claimed in claim 18, wherein said bolt comprises a cover plate which in said locking position closes off said slot up to said long edge.

20. Apparatus as claimed in claim 19, wherein after installation of said apparatus a top surface of said bolt is recessed below a top surface of said cover by an amount sufficient that when a vehicle is driven over said cover no load is imposed on said bolt.

21. Apparatus as claimed in claim 16, wherein said bolt is of substantially I-shaped cross section in correspondence with said one aperture in said cover.

22. Apparatus as claimed in claim 16, wherein said bolt comprises a clearing means for clearing dirt away from the slide path of said bolt during opening, as the bolt slides from said locking position into said opened position.

23. Apparatus as claimed in claim 22, wherein said clearing means comprises at least one beveled surface to lift up the dirt during sliding of said bolt.

24. Apparatus as claimed in claim 13, wherein said retaining means comprises a lug that projects into a retaining recess defined by said cover in the region of said bolt, and wherein said bolt comprises a retaining section that can extend under said lug.

25. Apparatus as claimed in claim 24, wherein said lug and said retaining recess are so complementarily shaped that displacement of said cover in a direction of said long edge is prevented.

26. Apparatus as claimed in claim 1, wherein said cover comprises two long edges and defines a plurality of openings spaced along these long edges, and wherein a plurality of hook-in elements are provided on said channel body which engage in said openings when said cover is set into place on said channel body.

27. Apparatus as claimed in claim 26, wherein said hook-in elements and said openings are disposed symmetrically on said channel body and said cover respectively in such a way that said cover can be set in place on said channel body in either of two orientations.

28. Apparatus as claimed in claim 1, wherein said cover comprises at least one retaining member which projects into said drainage channel and which prevents said one first fixing element from slipping out of said one receiving aperture.

29. Apparatus as claimed in claim 1, comprising a frame attached to said channel body into which said cover is located and wherein said one first fixing element is attached to said frame.

* * * * *